US005965208A

United States Patent [19]

Fagerholm et al.

[11] Patent Number: 5,965,208

[45] **Date of Patent: *Oct. 12, 1999**

[54] COATER BELT AND A COATING STATION INCLUDING SUCH A COATER BELT

[75] Inventors: Lars Fagerholm, Vanda, Finland; Juha Tiilikka, Halmstad, Sweden; Lawrence G. Miller, Raynham, Mass.; Jeanette Hansson, Halmstad, Sweden

[73] Assignee: Albany International Corp., Albany, N.J.

[ * ] Notice: This patent issued on a continued prosecution application filed under 37 CFR 1.53(d), and is subject to the twenty year patent term provisions of 35 U.S.C. 154(a)(2).

[21] Appl. No.: 08/881,042

[22] Filed: Jun. 25, 1997

[30] Foreign Application Priority Data

Jun. 28, 1996 [SE] Sweden ..... 9602600

[51] Int. Cl.[6] ..... B05D 1/28; B05C 1/00

[52] U.S. Cl. ..... 427/428; 118/239; 118/244

[58] Field of Search ..... 442/67, 68, 69, 442/70; 427/428; 118/239, 244

[56] References Cited

U.S. PATENT DOCUMENTS 5,298,124 3/1994 Eklund et al. ..... 162/306

*Primary Examiner*—Christopher Raimund

*Attorney, Agent, or Firm*—Kane, Dalsimer, Sullivan, Kurucz, Levy, Eisele and Richard, LLP

[57] ABSTRACT

A coater belt for carrying and supporting a web through a coating station on a paper or board machine, or an off-line coater, said belt comprising an endless base member and at least a first surface layer. Said surface layer is an impermeable coating comprising a first material and a particulate filler material. The filler material which are present in the web-contact surface provide a well-defined roughness on micro-scale of said web-contact surface. The web-contact surface further presents a well-defined surface energy for accomplishing an adhesion to the web for picking-up the web at an entrance side of the coating station and for holding the web against the coater belt during its path through the coating station.

11 Claims, 3 Drawing Sheets

COATER BELT AND A COATING STATION INCLUDING SUCH A COATER BELT

TECHNICAL FIELD

The present invention generally relates to coating of a surface of a moving web, especially a paper or board web in a paper machine. More particularly, the invention relates to a coater belt for use in a coating station and a coating station including such a coater belt. The invention is not limited to any specific type of coating station. A belt according to the preamble of claim 1 is disclosed in WO90/11135 (Beloit).

TECHNICAL BACKGROUND

Considering that the maximum possible machine width will soon be reached in today's modern paper machines, the operating speed thereof has to be further increased if the productivity is to be increased. However, since higher machine speeds will result in higher web stresses and, consequently, in an increased risk for web breakage, the machine speed must be limited to such an extent that the maximum tensioning of the web is not exceeded. The situation becomes even more complicated if one also considers the more frequent use of recycled fibres, which have lower strength than virgin fibres.

There are numerous examples in the prior art on how to obtain higher machine speeds by eliminating so called open draws from the paper machine. The term "draw" refers to the manner in which the web is transferred from one drive section to another in a paper machine. A draw is called a "closed draw" if the web is supported at least on one side at the point of transfer, e.g. by a felt. In other cases, it is called an "open draw". The supporting element, traditionally in the form of a felt, a woven fabric or a support drum, is especially useful for transferring a wet or moist web. In some positions of the paper machine there is a requirement for the smoothness of the drum as well as for the supporting length of the felt; in such cases belts having a coated web-contacting surface are used.

It has also been proposed to introduce some form of web supporting elements at previously unsupported positions of the paper machine, such as in a coating station.

In a conventional coating station, an amount of coating material is applied to a moving web. Known coating station may be arranged to apply the coating material on one or both sides of the web. The coating station may be located either "on-line" in a paper machine, normally just before a calendering station or a reeling-up station of the paper machine, or "off-line" separate from the paper machine. In the latter case, the web speed in the coating station must preferably be higher than the web speed in the paper machine. Otherwise, the coating station may become a "bottleneck" in the overall production line.

U.S. Pat. No. 4,761,309 (Beloit) discloses the use of a fabric as a backing element in a short dwell coating station. The object is to avoid so called air blistering, that is the formation of air pockets which are developed between a conventional backing roll and the web upstream relative to the short dwell coater when the web is moving at high speeds (>3000 feet/minute) and air is sucked into the coater unit.

The arrangement in U.S. Pat. No. 4,761,309 includes a backing roll having a perforate surface and a permeable belt disposed between the perforated roll surface and the web. When a vacuum is applied, the web is drawn into close contact with the belt thereby avoiding the formation of said air pockets between the web and the backing member. The permeable belt is a wire-mesh belt including two layers of different denier, of which the finer layer is in contact with the web in order to avoid marking.

WO90/11135 (Beloit), mentioned in the first paragraph, discloses the use of a "backing blanket" in a coating station. The backing blanket is guided in an endless path around two guide rollers which are spaced apart, so that the web, which is supported by the blanket, is running in a plane oriented tangentially relative to the guide rollers. A short dwell coater is disposed between the guide rollers and adjacent the web, on the side thereof facing away from the rollers, for applying a coating material on the web.

The backing blanket is of composite construction, including a woven base fabric and a surface layer in the form of a woven material, which is positioned in a plane parallel to the base fabric and has a lower denier (finer) than the denier of the base fabric (coarser).

The object of the arrangement disclosed in WO90/11135 is to accomplish a more even distribution of the coating material, by avoiding the occurrence of secondary flow of the coating material in opposition to the primary flow. By the use of said backing blanket, centrifugal forces on the coating material generated by conventional backing rollers are said to be avoided.

WO95/14816 (Valmet) discloses a tail threading arrangement in a coating station. The tail threading process, which is performed during start up and after web breaks, involves the step of providing an edge strip slit from the web to act as a "tail" of the web which is first threaded through the line and then widened to the normal width of the web. The object of the arrangement in this document is to positively support the web through essentially the entire machine and to have only very narrow open draws. To this end, the disclosed arrangement comprises a support belt in a coating station. The web to be coated enters onto said support belt from a delivering wire, so that the web travels together with the support belt through the coating station. The exposed side of the web not facing the support belt is coated with a coating material.

According to the teachings of this prior-art document, a support belt used in coating station must have a very smooth surface to keep the paper coating profile level. It is stated that the support belt material should have a smooth surface or maximally containing small-diameter micropores. The term belt is defined as any non-air-permeable, flat support element. The document gives no further information on the construction or materials of the support belt.

To the knowledge of the inventors of the present invention, the arrangement described in WO95/14816 has not been used in practice.

It is stated in WO95/14816 that since web adherence cannot be arranged by vacuum, additional support can be provided by air-jets. It is also stated that the web will tend to adhere relatively strongly to the smooth surface of the support belt, initially by static electricity, and after the coating application, adhesion is caused by the moisture of the web.

EP-A-0 576 115 (Albany International Corp.) discloses a transfer belt for carrying a paper sheet from a press nip in a paper machine to a transfer point.

Although this prior-art transfer belt in some aspects operates according to the same principles as the invention, there are in fact substantial differences. The operation of the transfer belt according to EP-A-0 576 115 requires a compression of the belt in order to accomplish a web-release function at the transfer point. More specifically, the transfer belt comprises a system of polymers and hard particles embedded therein. When the belt is compressed in the press nip, it becomes very smooth giving a good web contact. On the exit side of the nip the system expands, but differently at soft and hard regions. Thereby, the water film between the belt and the web is split or broken and the web can be released. This technique based on a pressure responsive belt cannot be used in a coating station, because there is not any substantial compressive pressure acting on the web-belt system in a coating station. Furthermore, the moisture content of a web in a press section being essentially higher (the moisture content appoximately 80% on the entrance side and 50% on the exit side) than that in a coating station (moisture content approximately 5–10% on the entrance side), the operating environment of this prior-art transfer belt and the invention are essentially different. The environment is nearly 100% dry in a coating station and, therefore, web handling problems in a coating station are caused by different factors than in the "wet" environment in a press section.

DISCLOSURE OF THE INVENTION

In general terms, the object of the present invention is to improve the prior-art coating station in terms of runnability, web control, uniform web coating and maximum machine speed.

A specific aim of the present invention is to accomplish this general object by providing an improved support belt (referred to as a coater belt) arranged to pick up a web prior to a coating station, carry and support the web through the coating station and release it to a drying section.

1. On the entrance side of the coating station, the adhesion between the web and the coater belt should be relatively strong, in order to ensure an effective pick-up of the web onto the coater belt, e.g. from an open draw or from a dryer fabric.
2. Also during its path through the coating station the web should adhere to the coater belt to an extent which ensures an good sheet control and thereby a high runnability of the web at high machine speeds (>1000 m/min). An enhanced sheet control at the location of the coating unit of the coating station will result in a higher web coating quality, such as a uniform web coating.
3. In contrast to the required adhesion mentioned under "1" and "2" above, at the exit side of the coating station the web is to be readily released from the coater belt and, therefore, on the exit side, the adhesion between the web and the coater belt should not be too strong. It is also important that the web is released along a defined, straight line in CD (Cross Direction). Broadly speaking one could say that the contact between the web and the coater belt should be strong and weak at the same time.
4. If, during the release of the web from the coater belt at the exit side of the coating station, some of the fibres of the web and/or coating material are not released from the coater belt, the latter must be easily cleaned.
5. High machine speeds must be possible According to a first aspect of the invention, the above and other objects are accomplished by a coater belt according to claim 1. Preferred embodiments of the inventive coater belt are set out in the dependent claims.

According to a second aspect of the invention, the above objects are accomplished by a coating station according to claim 11. Preferred embodiments of the inventive coating station are set out in the dependent claims.

Thus, according to the invention there is provided a coater belt, and a coating station including such a belt, wherein said belt comprises an endless base member and at least a first surface layer, which is arranged on the base member on a side thereof facing the web and which defines a web-contact surface, said belt being arranged to operate without any substantial compressive contact pressure between the belt and the web during its path through the coating station. The surface layer is an impermeable coating comprising a first material and a particulate filler material distributed in said first material. Particles of the particulate filler material which are present in the web-contact surface provide a well-defined topography on the micro-scale of said web-contact surface, corresponding to the size and axial dimensions of said particles, for promoting a release of the web from the coater belt at the exit side of the coating station. Furthermore, the web-contact surface presents a well-defined smoothness on macro-scale for preventing marking of the web, and a well-defined surface energy for accomplishing an adhesion to the web for picking-up the web at the entrance side of the coating station and for holding the web against the coater belt during its path through the coating station.

The above expression "endless base member" encompasses all types of base members which have been made endless in some way. Especially, the expression also encompasses an openable seam-type base member which is not made endless until it is installed on the papermachine by the aid of a suitable seam.

As to the above expression "without any substantial compressive contact pressure between the belt and the web", it will be appreciated that the web is only subjected to a pressure resulting from the application of the coating substance. However, this pressure will not give rise to any compression.

The surface topography of the inventive coater belt is essentially unaffected in the coating station, in contrast to the transfer belt disclosed in EP-A-0 576 115 referred to above, in which the belt is made completely smooth due to its passage through the press nip.

The inventive coater belt presents a marking-preventing smoothness on macro-scale, which can be achieved by a suitable surface treatment, such as grinding and/or superpolishing. However, owing to the presence the particulate filler material embedded in the belt coating material, such a grinding or superpolishing operation will not negatively affect the micro-scale roughness provided by the particles in the web-contact surface of the coater belt.

To summarise, according to the invention there is provided a coater belt for carrying and supporting a web through a coating station, and a coating station comprising such a novel coater belt. By selecting a suitable surface material, surface roughness and surface energy, the web-contact surface of the coater belt will operate effectively in a coating station. Trials have shown that both surface energy and surface roughness, on micro-scale level as well as on macro-scale level, are important parameters for the proper operation of the belt. If these parameters are suitably combined, and an adequate caliper is selected for the coater belt in respect of the actual application, the invention may provide a well operating support element which makes it possible to increase the machine speed without increasing the risk for web break.

According to the invention, the web-contact surface of the coater belt is deliberately provided with a certain, well-defined roughness on micro-scale level in order to ensure a web-release function at the exit side of the coating station. This is in clear contrast with the teachings in WO95/14816 referred to above, in which it is stated that a web-contact surface of a support belt for a coating station must be very smooth.

According to the invention, the release function of the belt is accomplished by providing a well-defined topography on micro-scale of the web-contact surface of the belt. After having been coated by a coating unit of the coating station the web will be subject to a certain moisture penetration, resulting in a very thin water film between the web and the belt. If the web-contact surface of the belt would have been made completely smooth, as suggested in WO95/14816, said water film would have resulted in an excessive adherence preventing the web from being released from the belt; however, because of a micro-scale roughness of the web-contact surface, in combination with a macro-scale smoothness of the same surface, the water film between the web and the belt can be effectively broken up by said micro-roughness for obtaining a release function, and this can be accomplished without any web-marking problems as a result of said macro-scale smoothness.

The inventive coater belt may have an elasticity in MD (Machine Direction) in order to compensate for any web elongation due to the coating, and/or to compensate for speed differences in open draws between the coating station and a subsequent unit.

The surface of the coater belt (top and bottom) should be wear resistant and cope with high pressure cleaning. In the case that the base member is coated on its top surface only, the bottom surface of the base member must be wear resistant. In a double-coated embodiment of the invention, the coated surface layers will constitute the wear resistant surfaces.

DESCRIPTION OF EMBODIMENTS OF THE INVENTION

Figure 1:
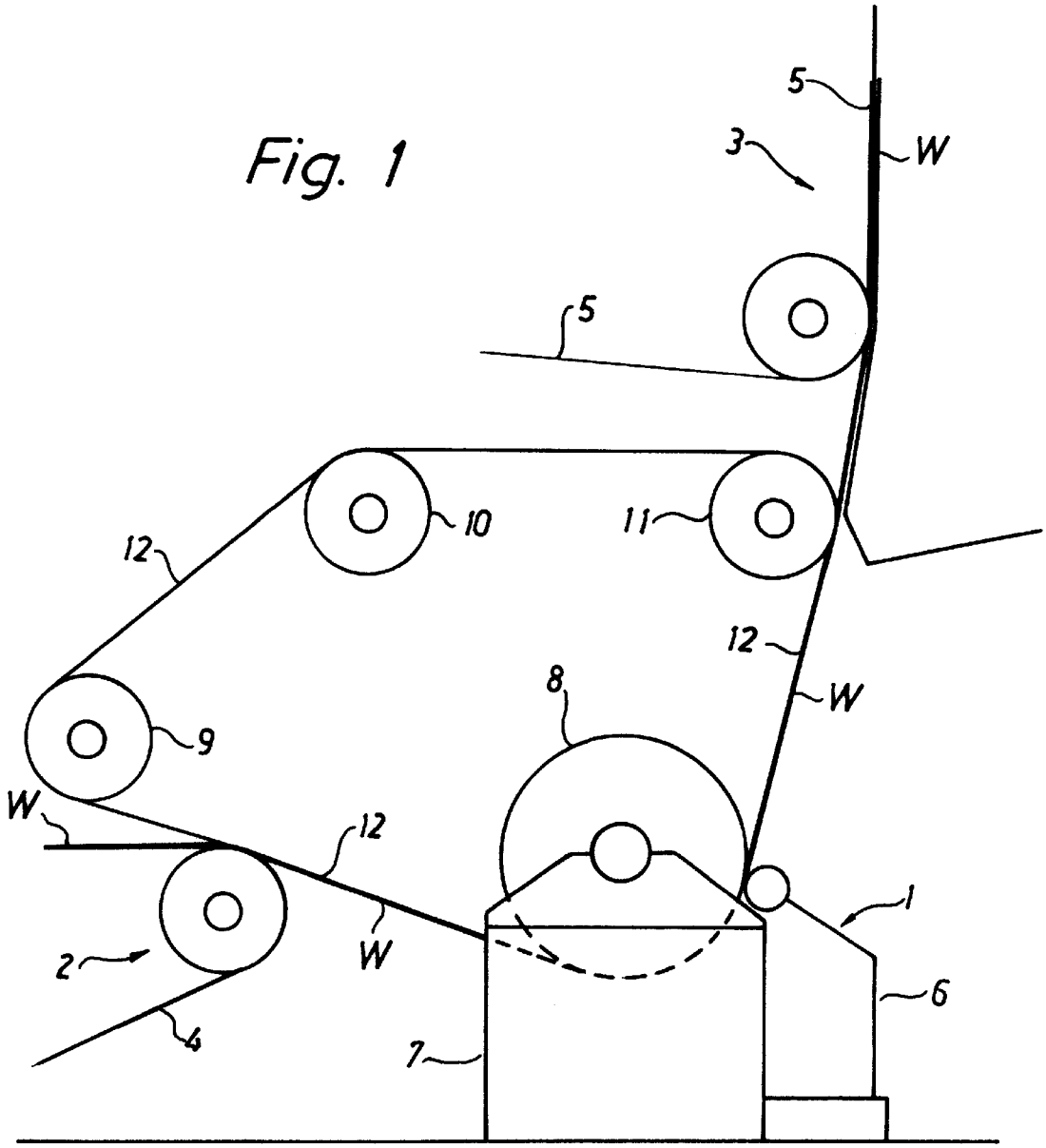
FIG. 1 is a schematic view of a coating station in which the inventive coater belt may be used.

FIG. 1 illustrates an on-line coating station 1 arranged in a paper machine between a delivering unit 2 and a receiving unit 3, e.g. two dryer sections each having an endless support fabric 4 and 5. The coating station 1 comprises a coating unit 6, a frame 7 supporting a backing roll 8, and three rollers 9, 10 and 11. A coater belt 12 in accordance with the invention is running in an endless path about the backing roll 8 and the three rollers 9–11.

A paper or board web W to be coated in the coating unit 1 is fed by the first support fabric 4 towards the entrance side of the coating unit 1, to be picked up and guided by the coater belt 12. More specifically, the web W will be picked up by a first surface layer (reference numeral 18 in FIGS. 3 and 4) provided on a base member (reference numeral 13 in FIGS. 2–4) of the coater belt 12, and then guided along the path of the coater belt 12 between the backing roll 8 and the coating unit 6, in order to receive a coating substance on its surface facing towards the coating unit 6.

The thus coated paper web W is fed by the coater belt 12 towards the exit side of the coating station 1, where the coated web W is picked up and guided by the second dryer fabric 5.

Figure 2:
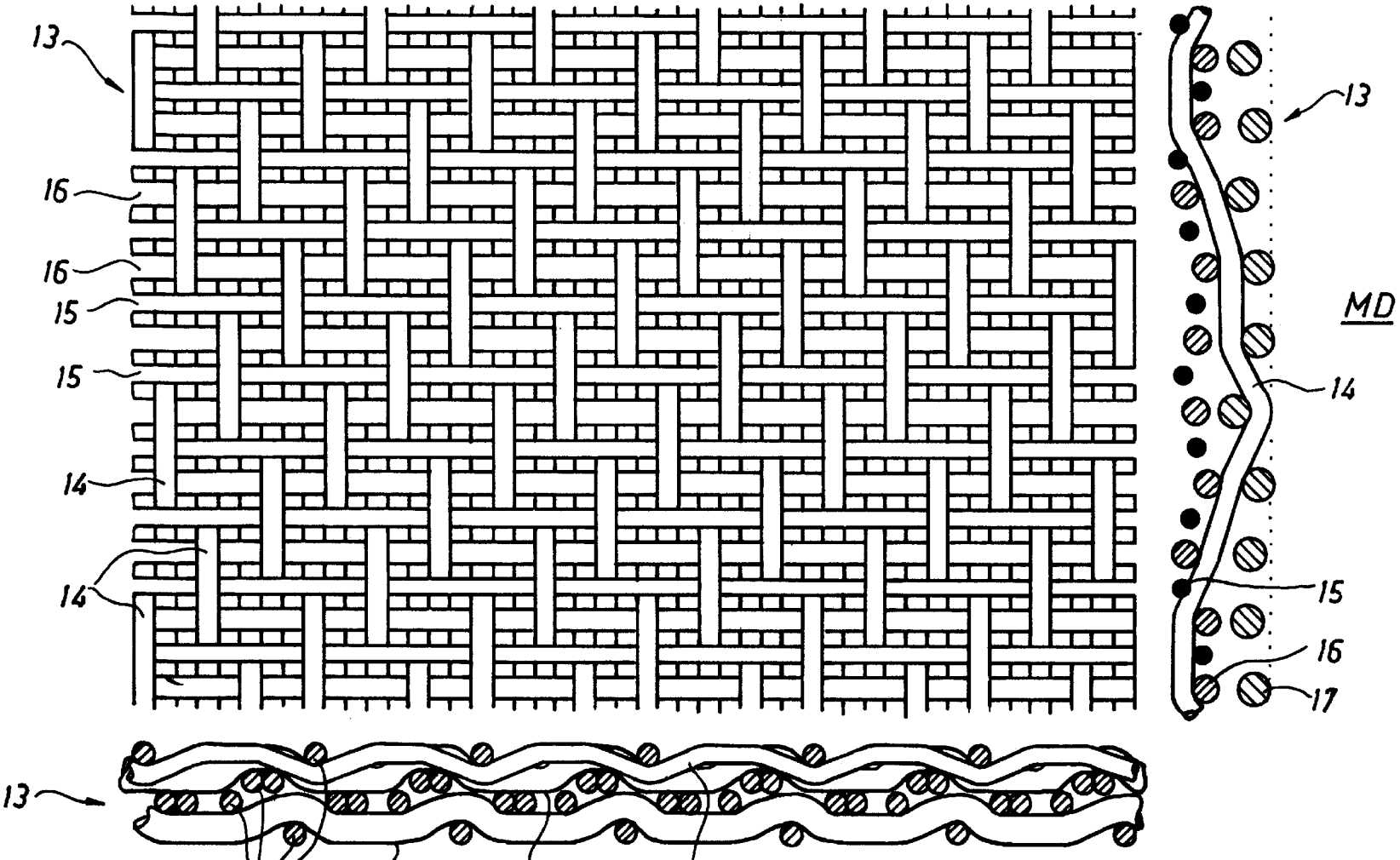
FIG. 2 illustrates a base member which may be used for the manufacturing of a coater belt in accordance with the invention.

FIG. 2 illustrates a base member 13 which has been used in a trial manufacturing of the coater belt 12 in FIG. 1. The base member 13 in FIG. 2 is a flat woven, double layer fabric of a type which is normally used as a forming fabric and produced under the name DUOTOP Q55. The lower portion of FIG. 2 is a sectional view of the base member 13 as seen in the warp direction (CD-view), whereas the right-hand portion of FIG. 2 is a sectional view of the base member 13 as seen in the weft or shute direction (MD-view). In this example, the base member 13 includes 0.15 mm PET (polyester) warp yearns 14; 0.12 mm PA (polyamid) weft yarns 15; 0.17 mm PET weft yarns 16; and 0.20 mm PA/PET weft yarns 17. The mesh count (/cm) was 72 in MD and 63.5 in CD. The caliper of the base member 13 was 0.64 mm, and its void volume was 0.36 $mm^3/mm^2$. The modulus of the base member was relatively high, in the order of 13 kN/m at 1% elongation. Both in the top surface and the bottom surface of the base member 13, the plane difference between weft and warp was essentially zero.

Figure 3:
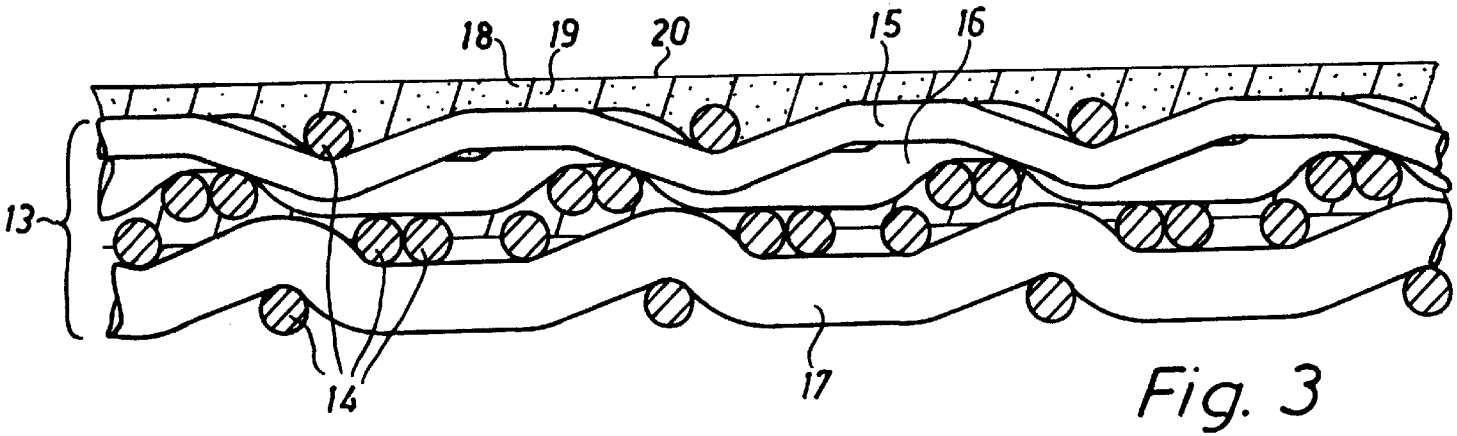
FIG. 3 is a sectional view of an embodiment of a single-coated belt in accordance with the invention.
Figure 4:
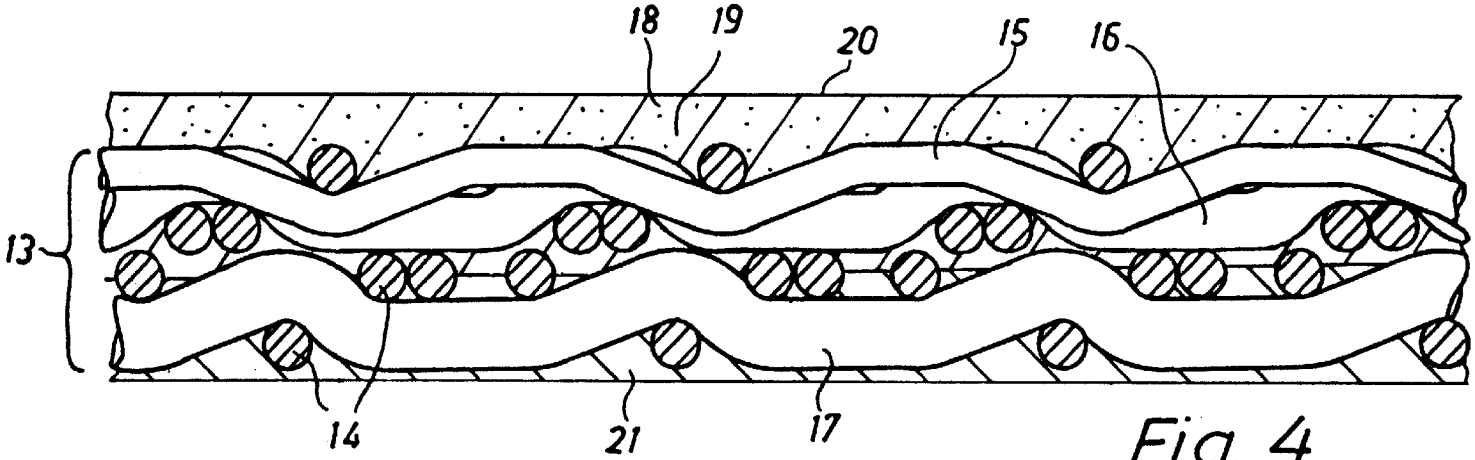
FIG. 4 is a sectional view of an embodiment of a double-coated belt in accordance with the invention.

The following is an example on how to accomplish the belt coating of the coater belt 12 in FIG. 1. Reference will now be made to FIGS. 3 and 4, schematically illustrating how the base member 13 in FIG. 2 is coated on one surface (FIG. 3) or on both surfaces (FIG. 4). In FIGS. 3 and 4, the same reference numerals are used as in FIG. 2. A first surface layer is indicated at 18, defining a web-contacting surface 20, and a second surface layer is indicated at 21.

In broad terms, the process is in many aspects similar to the process disclosed in the above-mentioned EP-A1-0 576 115. The latter document is therefore hereby incorporated by reference.

The coating can be an inorganic particle filled resin composition mixed in batches of a suitable size, according to the following formula:

TABLE I

| COMPONENT | WEIGHT % (WET) |
|---|---|
| Aliphatic polycarbonate urethane dispersion (35% solids) | 78.6 |
| Ammonium hydroxide | 1.2 |
| Kaolin clay (particulate filler) | 16.4 |
| Surfactant (non-ionic acetylenic diol) | 0.9 |
| Melamine formaldehyde resin | 2.7 |
| Amine salt of p-toluene sulfonic acid (25–28% solids) | 0.2 |

Ingredients may be added into the polymeric dispersion in the order listed in Table I. Other additives may be used to improve processability, such as thickeners and defoamers. The mixing of the components may be carried out in an industrial mixer at a mixing speed of 550 rpm.

Kaolin clay in the Table I is only one example of a particulate filler (schematically indicated at reference numeral 19 in FIGS. 3 and 4) that can be included in the belt coating. The size distribution of the particulate filler may vary from <1 $\mu$m to over 100 $\mu$m. Normally, a filler will present a certain size distribution. In the present embodiment, at least 75% of the particles of the particulate filler will normally be smaller than 10 $\mu$m, and no more than 0.5% will be larger than 53 $\mu$m. The type, shape and concentration of the particulate filler in the belt coating must be selected in order to achieve the target microscale roughness and surface energy ranges for the belt coating.

The belt coating may be applied to an endless base member 13 according to FIG. 2 of the coater belt 12 by means of a blade-coating procedure while the base member is moved in an endless path around two rollers at an appropriate speed. The blade height may be gradually raised to smooth the mixture being applied to achieve greater thickness. Initially, the blade height may be set to about 0.0 mm, so that is barely contacting the surface of the base. In practice, a certain minimum pressure will be applied to the coating substance during the coating of the belt, in order to accomplish a penetration into the base member. The degree of penetration can also be controlled by the viscosity of the substance.

In the embodiment shown in FIG. 4, the second surface layer 21 on the back side of the coater belt 12 may be a coating of a different composition than the coating 18 arranged on the web-facing side of the coater belt 12, especially a wear-resistant coating. Another embodiment (not shown) with coating on both sides may be obtained in a single-sided coating at 100% penetration. The demands on the two surface layers (18/21) must then have to be balanced as the coating composition would be the same.

Subsequent to the application of the mixture onto the base member, the coating (18/21) is dried using IR or hot air. The belt 12 should then be cured to ensure that the coating adequately crosslinks, providing a positive "mechanical interlock" with the base member so that the coating will be prevented from delaminating during operation on the paper coater. The curing process may be performed by using IR or hot air, and typically the coating is cured at temperature of 150° C.

Subsequent to the drying and curing processes, the coating (18/21) is ground. To this end, abrasive papers in a coarseness range of 180 to 220 grit may be used to provide a uniform belt surface (20). Finer abrasive papers in a coarseness range of 15 to 60 $\mu$m (super polishing) may then be used to produce a surface in the desired macroscale roughness range. If the grinding/finishing is to be performed in a wet environment for eliminating grind marks, the belt coating must be fully dry and cured prior to finishing.

The following specifications were used in a trial performed according to the above description:

| | | |
|---|---|---|
| Belt length: | 7.26 m | |
| Caliper: | 0.91–1.02 mm | after coating and before finishing |
| | 0.89–0.97 mm | finished |
| | 0.64 mm | base fabric only |
| Surface ($R_A$): | 1.2–1.3 $\mu$m | after coating |
| | 0.7–1.0 $\mu$m | finished |

We claim:

1. In a method of coating a paper web of the type wherein the paper web is directed around a backing roll and between the backing roll and a coating station, the improvement comprising:

providing a coater belt comprising an endless base member and at least a first surface layer, said surface layer being arranged on an outer surface of the base member and defining a web-contact surface, said surface layer being an impermeable coating comprising at least a first material and a particulate filler material distributed in said first material; said particulate filler material on said web-contact surface promoting a release of said web therefrom, said web-contact surface further having a roughness in the range from 0.2 to 2 microns for preventing the marking of said web, said web-contact surface picking up said web at an entrance side of said coating station and holding said web against said coater belt during its path through said coating station;

disposing said coater belt around said backing roll;

directing a paper web to be coated by said coating station between said backing roll and said coating station on said web-contact surface of said coater belt; and coating said paper web.

2. A coating station for a paper machine, comprising a supporting belt for carrying and supporting a web to be coated through the coating station, and a coating unit for applying a coating material on a surface of the web facing away from the supporting belt, without any substantial external compressive pressure being present in the coating station between the supporting belt and the web supported thereby during its path through the coating station, and wherein said supporting belt comprises an endless base member and at least a first surface layer, which is arranged on the base member on a side thereof facing the web and which defines a web-contact surface, wherein:

said surface layer is an impermeable coating comprising at least a first material and a particulate filler material distributed in said first material;

said particulate filler material on said web-contact surface promotes a release of said web from said coater belt at a point of release in said coating station;

said web-contact surface having a roughness in the range from 0.2 to 2 microns for preventing marking of said web; and said web-contact surface picks up said web at an entrance side of the coating station and holds said web against said coater belt during its path through said coating station.

3. An improved coating station for coating a paper web, said coating station being of the type having a coating unit for applying a coating material on a surface of the web and a backing roll around which the web passes while being coated by the coating unit, wherein the improvement comprises:

a coater belt for carrying and supporting the web through the coating station, said belt running around said backing roll and comprising an endless base member and at least a first surface layer, said first surface layer being on an outer surface of said belt and facing said web and defining a web-contact surface, said belt being arranged to operate without any substantial compressive contact pressure between itself and the web during its path through the coating station;

said surface layer being an impermeable coating comprising a first material and a particulate filler material distributed in said first material;

particles of said particulate filler material residing on the web-contact surface promoting a release of said web from the coater belt at an exit side of the coating station;

said web-contact surface further having a roughness in the range from 0.2 to 2 microns for preventing marking of the web; wherein said web-contact surface picks up said web at an entrance side of said coating station and holds said web against said coater belt during its path through said coating station.

4. A coating station as claimed in claim 3, wherein said web-contact surface has a surface energy having a first value at said particles of said filler material and a second, different value at said first material.

5. A coating station as claimed in claim 3, wherein said particulate filler material is hydrophilic.

6. A coating station as claimed in claim 3, wherein said web-contact surface of said coater belt has a surface energy greater than 30 $mJ/m^2$.

7. A coating station as claimed in claim 3, wherein said coater belt has a caliper which is less than 4 mm.

8. A coating station as claimed in claim 3, wherein said coater belt further comprises a second surface layer arranged on said base member on a back side thereof facing away from said web.

9. A coating station as claimed in claim 8, wherein said second surface layer on the back side of said coater belt is a coating of a different composition than said coating arranged on the web-contact side of said coater belt.

10. A coating station as claimed in claim 9, wherein said second surface layer is a wear-resistant coating.

11. A coating station as claimed in claim 3, wherein said base member comprises a woven fabric.

* * * * *